US009335684B2

(12) United States Patent
Shibata

(10) Patent No.: US 9,335,684 B2
(45) Date of Patent: May 10, 2016

(54) IMAGE HEATING APPARATUS WITH BELT UNIT AND HOLDING DEVICE CONFIGURED TO HOLD BELT UNIT

(71) Applicant: CANON KABUSHIKI KAISHA, Tokyo (JP)

(72) Inventor: Kota Shibata, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/150,057

(22) Filed: Jan. 8, 2014

(65) Prior Publication Data

US 2015/0286176 A1 Oct. 8, 2015

Related U.S. Application Data

(63) Continuation of application No. PCT/JP2012/068043, filed on Jul. 10, 2012.

(30) Foreign Application Priority Data

Jul. 14, 2011 (JP) ..... 2011-155631

(51) Int. Cl.
*G03G 15/20* (2006.01)

(52) U.S. Cl.
CPC ..... *G03G 15/2053* (2013.01); *G03G 15/2017* (2013.01); *G03G 2215/00156* (2013.01); *G03G 2215/2019* (2013.01)

(58) Field of Classification Search
CPC ..... G03G 2215/2019; G03G 15/2017; G03G 2215/00156
See application file for complete search history.

(56) References Cited

U.S. PATENT DOCUMENTS

| | | | | |
|---|---|---|---|---|
| 4,269,594 | A * | 5/1981 | Umans et al. | 432/59 |
| 4,894,687 | A * | 1/1990 | Beaudet | 399/307 |
| 5,778,294 | A | 7/1998 | Hiraoka et al. | |
| 6,078,766 | A | 6/2000 | Kurotaka | |
| 7,430,394 | B2 | 9/2008 | Fujimori et al. | |
| 7,570,909 | B2 | 8/2009 | Asakura et al. | |
| 7,596,334 | B2 * | 9/2009 | Yoshino et al. | 399/67 |
| 7,706,707 | B2 * | 4/2010 | Minakuchi et al. | 399/67 |

(Continued)

FOREIGN PATENT DOCUMENTS

| | | |
|---|---|---|
| EP | 1 635 229 A | 3/2006 |
| JP | 8-234597 A | 9/1996 |

(Continued)

OTHER PUBLICATIONS

Apr. 21, 2015 Office Action in counterpart Korean Patent Application No. 10-2014-7003127.

(Continued)

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A fixing device is provided in which an external heating belt 105 for heating a fixing roller 101 from an outside is capable of correcting offset movement of supporting rollers 103, 104 in an axial direction. the external heating belt 105 is rotatable about a rotation shaft 209 so as to cross relative to a generatrix direction of the fixing roller 101. further, the rotational shaft 209 is disposed at a position offset toward an upstream side with respect to a rotational moving direction of the fixing roller 101.

25 Claims, 13 Drawing Sheets

(56) References Cited

U.S. PATENT DOCUMENTS

| | | | | |
|---|---|---|---|---|
| 7,711,306 | B2 | 5/2010 | Kagawa | |
| 7,761,045 | B2 | 7/2010 | Fujimori et al. | |
| 7,815,042 | B2 | 10/2010 | Oishi | |
| 7,920,814 | B2 * | 4/2011 | Atwood et al. | 399/302 |
| 7,962,080 | B2 * | 6/2011 | Kameda | 399/323 |
| 8,218,990 | B2 | 7/2012 | Toyohara et al. | |
| 8,331,821 | B2 | 12/2012 | Nakayama | |
| 8,417,150 | B2 | 4/2013 | Kameda | |
| 2006/0054467 | A1 | 3/2006 | Oishi | |
| 2007/0189817 | A1 | 8/2007 | Kagawa | |
| 2007/0248389 | A1 | 10/2007 | Asakura et al. | |
| 2008/0003009 | A1 | 1/2008 | Minakuchi et al. | |
| 2008/0317526 | A1 | 12/2008 | Fujimori et al. | |
| 2010/0021194 | A1 | 1/2010 | Toyohara et al. | |
| 2010/0172669 | A1 | 7/2010 | Nakayama | |
| 2011/0142496 | A1 | 6/2011 | Kameda | |

FOREIGN PATENT DOCUMENTS

| | | | |
|---|---|---|---|
| JP | 9-90787 | A | 4/1997 |
| JP | 9-309642 | | 12/1997 |
| JP | 2000-75697 | A | 3/2000 |
| JP | 2000-75698 | A | 3/2000 |
| JP | 2000-75699 | A | 3/2000 |
| JP | 2000-75700 | A | 3/2000 |
| JP | 2006-78612 | A | 3/2006 |
| JP | 2007-212896 | A | 8/2007 |
| JP | 2007-292891 | | 11/2007 |
| JP | 2008-9151 | A | 1/2008 |
| JP | 2008-033227 | | 2/2008 |
| JP | 2008-197576 | A | 8/2008 |
| JP | 2010-097151 | A | 4/2010 |
| JP | 2010-160290 | A | 7/2010 |
| JP | 2011-123414 | A | 6/2011 |
| RU | 2397527 | C2 | 8/2010 |

OTHER PUBLICATIONS

International Search Report and Written Opinion of International Search Authority dated Aug. 28, 2012 in PCT/JP2012/068043.

Communication dated Mar. 12, 2015 in European Patent Application No. 12811206.7.

Mar. 12, 2015 Office Action in counterpart Russian Patent Application No. 2014105468/28(008699) and English translation thereof.

Russian Decision on Grant issued in counterpart Russian Patent Application No. 2014105468, dated Sep. 30, 2015 and English Translation.

Aug. 3, 2015 Office Action in counterpart Chinese Patent Application No. 201280034092.4 and English translation thereof.

Korean Office Action issued in counterpart Korean Patent Application No. 10-2014-7003127, dated Feb. 23, 2016.

* cited by examiner

IMAGE HEATING APPARATUS WITH BELT UNIT AND HOLDING DEVICE CONFIGURED TO HOLD BELT UNIT

FIELD OF THE INVENTION

The present invention relates to an image heating apparatus for heating a toner image on a sheet. The image heating apparatus is used with an image forming apparatus such as a printer, a copying machine, a facsimile machine or a complex machine having functions of such devices, of an electrophotographic type or electrostatic recording type, for example.

BACKGROUND ART

Various conventional image forming apparatuses are known, among which electrophotographic type image forming apparatuses are widely used. For such an image forming apparatus, a high productivity (print number per unit time) on various sheets (recording materials) such as thick paper sheets is desired.

In such an electrophotographic type image forming apparatus, a speed-up of the fixing operation of a fixing device (image heating apparatus) is desired to enhance the productivity with the thick paper having a large basis weight. However, in the case of thick paper sheet, a larger amount of heat is deprived of the fixing device during the sheet processing as compared with the case of thin paper sheet, and therefore, the heat quantity required by the fixing operation is larger than in the case of the thin paper sheet. A method is known in which the productivity is lowered for the thick paper (the fixing speed is lowered, or the print number per unit time is decreased).

As a method not lowering the productivity, an external heating type has been proposed in which a heating member is contacted to an outer surface of a fixing roller (rotatable heating member) to maintain an outer surface temperature of the fixing roller at a target temperature. In a proposal of such an external heating type, an external heating belt (endless belt) rotatably stretched around two supporting rollers, by which a contact area with the fixing roller is increased significantly, thus improving the temperature maintaining property (Japanese Laid-open Patent Application 2007-212896).

However, it is practically difficult to assemble and maintain the two supporting rollers with high precision parallelism therebetween, and as a result, if the parallelism is not assured, the external heating belt shifts in a widthwise direction, which leads to a deterioration of the traveling stability of the external heating belt.

It would be considered to control the shifting of the external heating belt by inclining one of the supporting rollers relative to the other supporting roller, but it is difficult to employ such a method for the external heating belt which has to perform the function of heating the fixing roller.

This is because with such a method, a one axial end portion side of the one of the supporting roller is displaced relative to the other end portion side, with which a part of a region of the supporting roller which has to contact the external heating belt may separate from the fixing roller by the displacement. If this occurs, the function of heating the fixing roller is deteriorated with the result of improper fixing.

DISCLOSURE OF THE INVENTION

Accordingly, it is an object of the present invention to provide an image heating apparatus capable of improving the traveling stability of the endless belt for externally heating the rotatable heating member.

The present invention provides an image heating apparatus, comprising a rotatable heating member for heating a toner image on a sheet; a belt unit including an endless belt contacting with an outer surface of said rotatable heating member to heat it, and a supporting roller rotatably supporting said endless belt and capable of urging said endless belt to said rotatable heating member so as to contact said endless belt to said rotatable heating member; and a holding device for holding said belt unit such that an axial direction of said supporting roller at the time when endless belt is in contact with said rotatable heating member is capable of crossing with a generatrix direction of said rotatable heating member.

The present invention provides an image heating apparatus, comprising a rotatable heating member for heating a toner image on a sheet; a rotatable heating member for heating a toner image on a sheet; a belt unit including an endless belt contacting with an outer surface of said rotatable heating member to heat it, and a supporting roller rotatably supporting said endless belt and capable of urging said endless belt to said rotatable heating member so as to contact said endless belt to said rotatable heating member; and a holding device for holding said belt unit swingably in such a direction that an axial direction of said supporting roller at the time when endless belt is in contact with said rotatable heating member crosses with a generatrix direction of said rotatable heating member.

The present invention provides an image heating apparatus, comprising a rotatable heating member for heating a toner image on a sheet; a belt unit including an endless belt contacting with an outer surface of said rotatable heating member to heat it, and two supporting rollers rotatably supporting said endless belt and capable of urging said endless belt to said rotatable heating member so as to contact said endless belt to said rotatable heating member; and a holding device for holding said belt unit swingably in such a direction that axial directions of said two supporting rollers cross with a generatrix direction of said rotatable heating member while said two rollers maintain said endless belt in press-contact to said rotatable heating member.

The present invention provides an image heating apparatus, comprising a rotatable heating member for heating a toner image on a sheet; a belt unit including an endless belt contacting with an outer surface of said rotatable heating member to heat it, and two supporting rollers rotatably supporting said endless belt and capable of urging said endless belt to said rotatable heating member so as to contact said endless belt to said rotatable heating member; and a swing shaft provided in a side opposite said rotatable heating member with respect to said endless belt and extending substantially in parallel with a normal line direction of a surface of said endless belt which is between said two rollers; and a holding device holding said belt unit swingably about said swing shaft.

PREFERRED EMBODIMENTS OF THE INVENTION

Embodiments of the present invention will be described specifically. The embodiments are preferred examples of the present invention, but the present invention is not limited to the embodiments, and the various structures can be modified within the concept of the present invention.

First Embodiment

(1) Image Forming Apparatus

Figure 1:
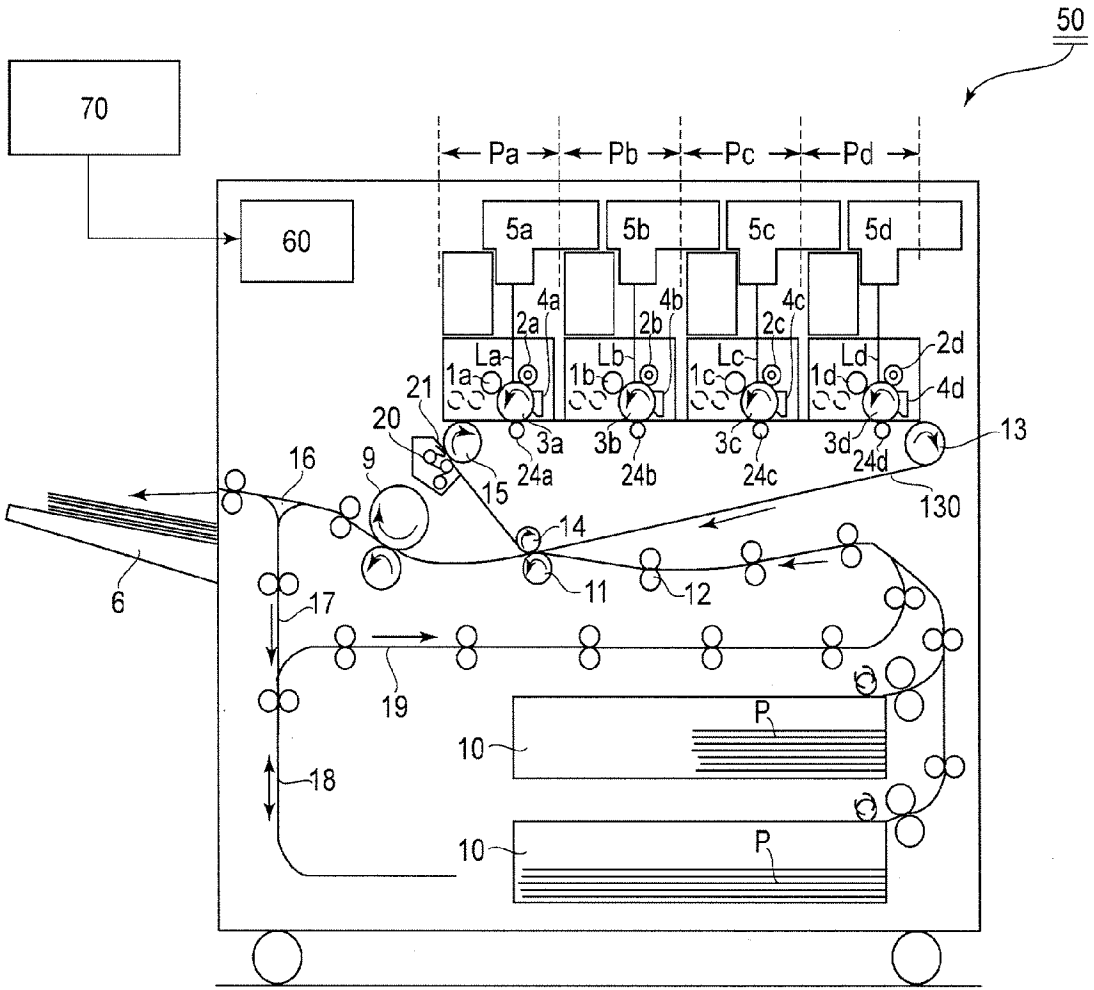
FIG. 1 is a schematic illustration of an image forming apparatus according to a first embodiment.

FIG. 1 is a schematic illustration of an example of an image forming apparatus 50 comprising a fixing device 9 functioning as an image heating apparatus according to the present invention. The device 50 is an electrophotographic color laser beam printer of an intermediary transfer type and an in-line type. It can form a full-color image on a recording material P on the basis of an image signal inputted to a control circuit portion 60 from a host apparatus 70 such as a personal computer.

In the device 50, there are provided first, second, third and fourth image forming stations Pa, Pb, Pc, Pd which perform concurrently to form different color toner images through an electrophotographic process. The image forming stations Pa, Pb, Pc and Pd include respective image bearing members which are electrophotographic photosensitive drums 3*a*, 3*b*, 3*c* and 3*d*, on which different color toner images are formed.

Adjacent to the drums 3*a*, 3*b*, 3*c* and 3*d*, an intermediary transfer belt 130 as an intermediary transfer member which makes circulative movement is provided, and the different color toner images are sequentially and superimposedly primary-transferred onto the belt 130 from the drum 3*a*, 3*b*, 3*c* and 3*d*. The toner images on the belt are secondary-transferred onto the recording material P by a secondary transfer roller 11. The recording material P having the transferred toner image is fixed by heat and pressure in the fixing device 9, and then the recording material P is discharged onto the tray 6 outside the apparatus as an output print.

Around each of the drums 3*a*, 3*b*, 3*c* and 3*d*, a drum charger 2*a*, 2*b*, 2*c*, 2*d*, a developing device 1*a*, 1*b*, 1*c*, 1*d*, a primary transfer charger 24*a*, 24*b*, 24*c*, 24*d* and a cleaner 4*a*, 4*b*, 4*c*, 4*d* are provided. In an upper part in the device, laser scanners 5*a*, 5*b*, 5*c* and 5*d* are provided.

The drums 3*a*, 3*b*, 3*c* and 3*d* are uniformly charged by the chargers 2*a*, 2*b*, 2*c*, 2*d*, respectively. Laser beam emitted from the laser scanner 5*a*, 5*b*, 5*c* and 5*d* is deflected by a rotating polygonal reflection mirror and is condensed on the drum 3*a*, 3*b*, 3*c*, 3*d* along on generatrix thereof by a fθ lens, thus exposing (La, Lb, Lc, Ld) the drum 3*a*, 3*b*, 3*c*, 3*d*. By this, latent images are formed on the drums 3*a*, 3*b*, 3*c* and 3*d* corresponding to the image signal.

In this embodiment, the developing devices 1*a*, 1*b*, 1*c*, 1*d* are filled with predetermined amounts of cyan, magenta, yellow and black toners as developers. The developing devices 1*a*, 1*b*, 1*c* and 1*d* develop and visualize the latent images on the drums 3*a*, 3*b*, 3*c* and 3*d* into a cyan toner image, a magenta toner image, a yellow toner image and a black toner image, respectively.

The belt 130 is rotated at the same peripheral speed as that of the drum 3 in the direction indicated by the arrow. The first color image, that is, the yellow toner image is passed through a contact portion (primary transfer nip) between the drum 3*a* and the belt 130. In the passing process, it is primary-transferred onto an outer peripheral surface of the belt 130 by a pressure and an electric field formed by a primary transfer bias applied to the belt 130 from a primary transfer charger 24*a*.

Similarly, a second color image, that is, the magenta toner image, a third color image, that is, the cyan toner image, and a fourth color image, that is, the black toner image are sequentially superimposedly transferred above belt 130, so that a synthesized color toner image is formed corresponding to the color image information inputted to the device 50.

After the completion of the primary-transfer, the drums 3*a*, 3*b*, 3*c* and 3*d* are cleaned by the respective cleaners 4*a*, 4*b*, 4*c* and 4*d* so that the untransferred toner is removed to prepare the next latent image forming operation. The toner and foreign matter remaining on the belt 130 are wiped out by contacting cleaning web (nonwoven fabric the 21 of a web cleaner 20 to the surface of the belt 130.

The belt 130 is stretched around three rollers 13, 14 and 15, one (roller 14) of which nips the belt 130 with the secondary transfer roller 11 to form a secondary transfer nip between the belt 130 and the secondary transfer roller 11. The roller 11 is supplied with a predetermined secondary transfer bias voltage from a secondary transfer bias voltage source.

In the secondary transfer nip, the synthesized color toner image is transferred from the belt 130 onto the recording material (sheet) P. More particularly, the recording material P is fed at predetermined timing to the secondary transfer nip through registration rollers 12 and a pre-transfer prior guide from the sheet feeding cassette 10, and is nipped and fed by the nip. Simultaneously, the secondary transfer bias voltage is applied to the roller 11 from the bias voltage source. By the secondary transfer bias voltage, the synthesized color toner image is transferred from the belt 130 onto the recording material P. The recording material P now carrying the transferred toner image having passed through the nip is separated from the belt 130 and is introduced into the fixing device 9, where it is subjected to the heat and the pressure, by which the powder image is fixed into a fixed image.

In the case of a simplex copy mode (print only on one-side of the sheet), the recording material P departing the fixing device 9 is discharged to the sheet discharge tray 6 outside the apparatus through sheet path provided at an upper side of a flapper 16.

In the case of a duplex copy mode (print on both sides) selected, the recording material P having the image only on one side and having departed the fixing device 9 is introduced to the sheet path 17 on a recirculation feeding mechanism, by the flapper 16. The recording material enters a switchback sheet path 18 and is fed out of the sheet path 18, and it is guided to the re-feeding sheet path 19. The recording material is re-introduced at predetermined timing to the secondary transfer nip passing the registration roller 12 and the pre-transfer prior guide from the sheet path 19, in the state that it is reversed in the facing orientation.

By this, a toner image is secondary-transferred from the belt 130 onto the second surface of the recording material P. The recording material P now having the secondary-transferred toner image on the second surface is separated from the belt 130 and is re-introduced into the fixing device 9, where it is subjected to the fixing process, and then is discharged to the sheet discharge tray 6 outside the apparatus as a duplex copy.

In a monochromatic mode operation, an image forming station for the designated color carries out the image forming operation. In the other image forming station, the drum is rotated, but the image forming operation is not carried out.

(2) Fixing Device

Figure 2:
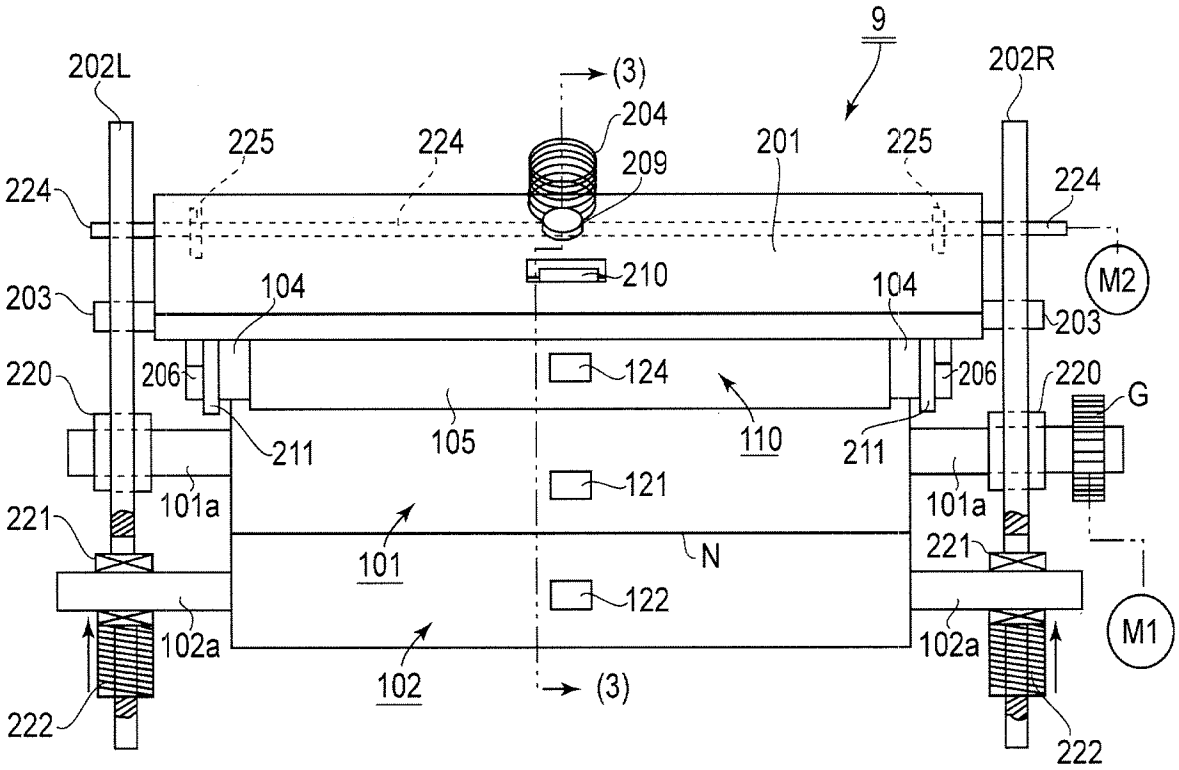
FIG. 2 is a partly cut-away substantial front view of a major part of a fixing device.
Figure 3:
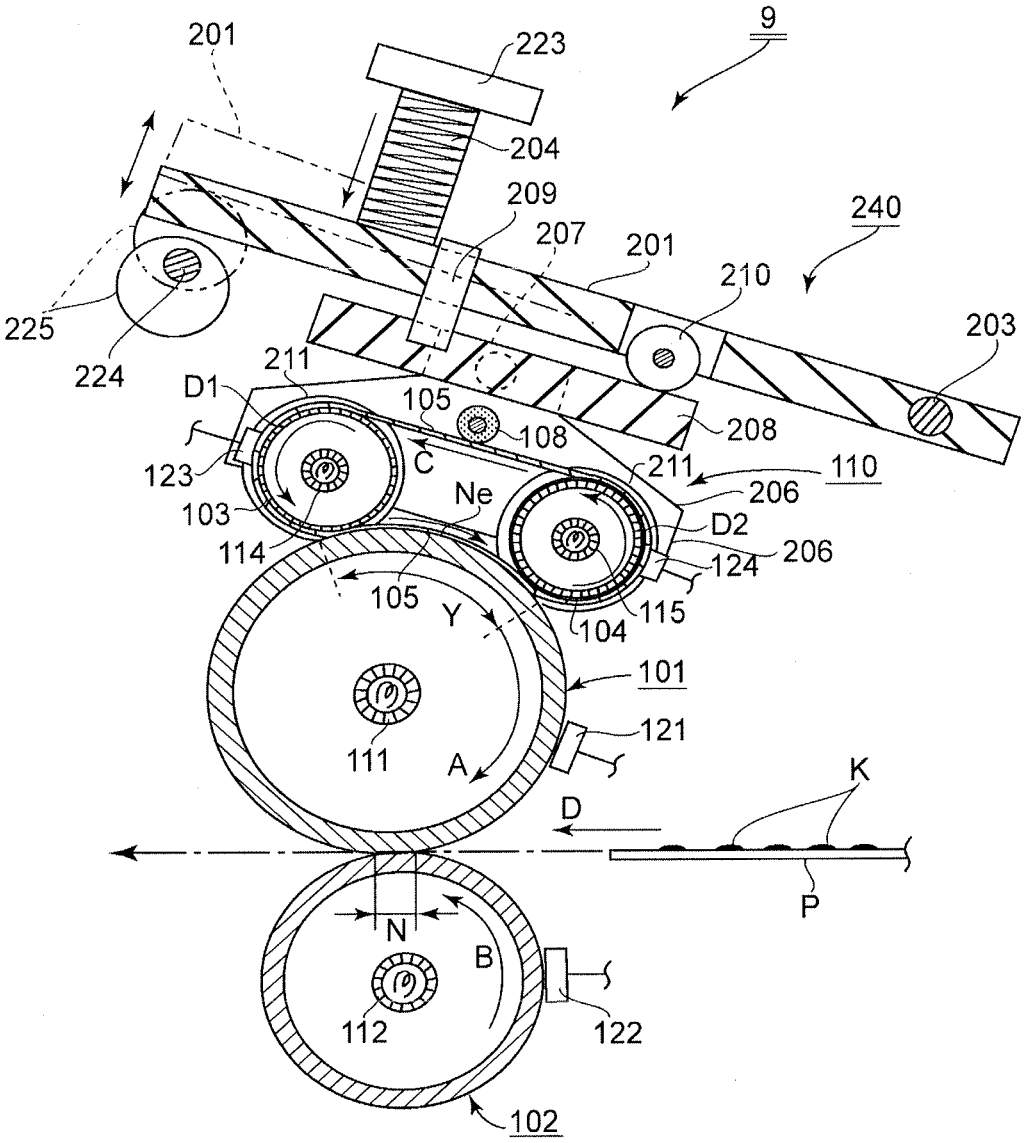
FIG. 3 is an enlarged right-hand side view taken along line (3)-(3) of FIG. 2.
Figure 4:
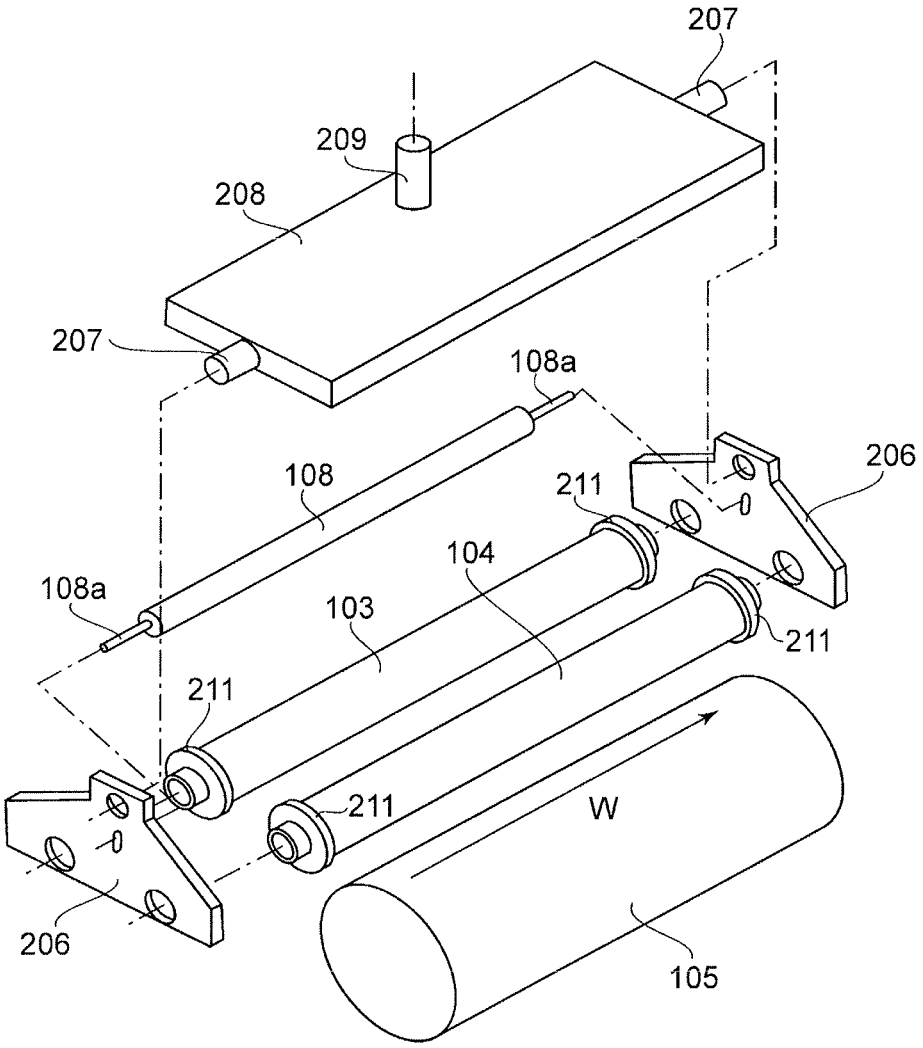
FIG. 4 is an exploded perspective view of an external heating belt assembly.
Figure 5:
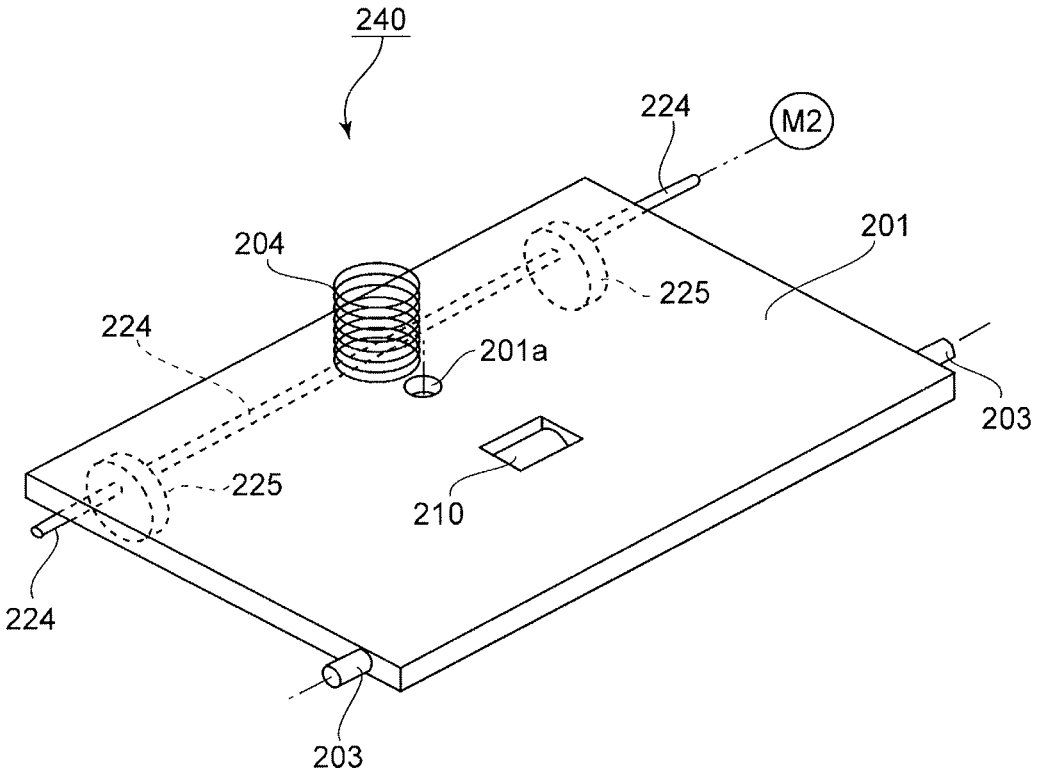
FIG. 5 is a perspective view of a pressing—pressure releasing mechanism for the assembly.
Figure 6:
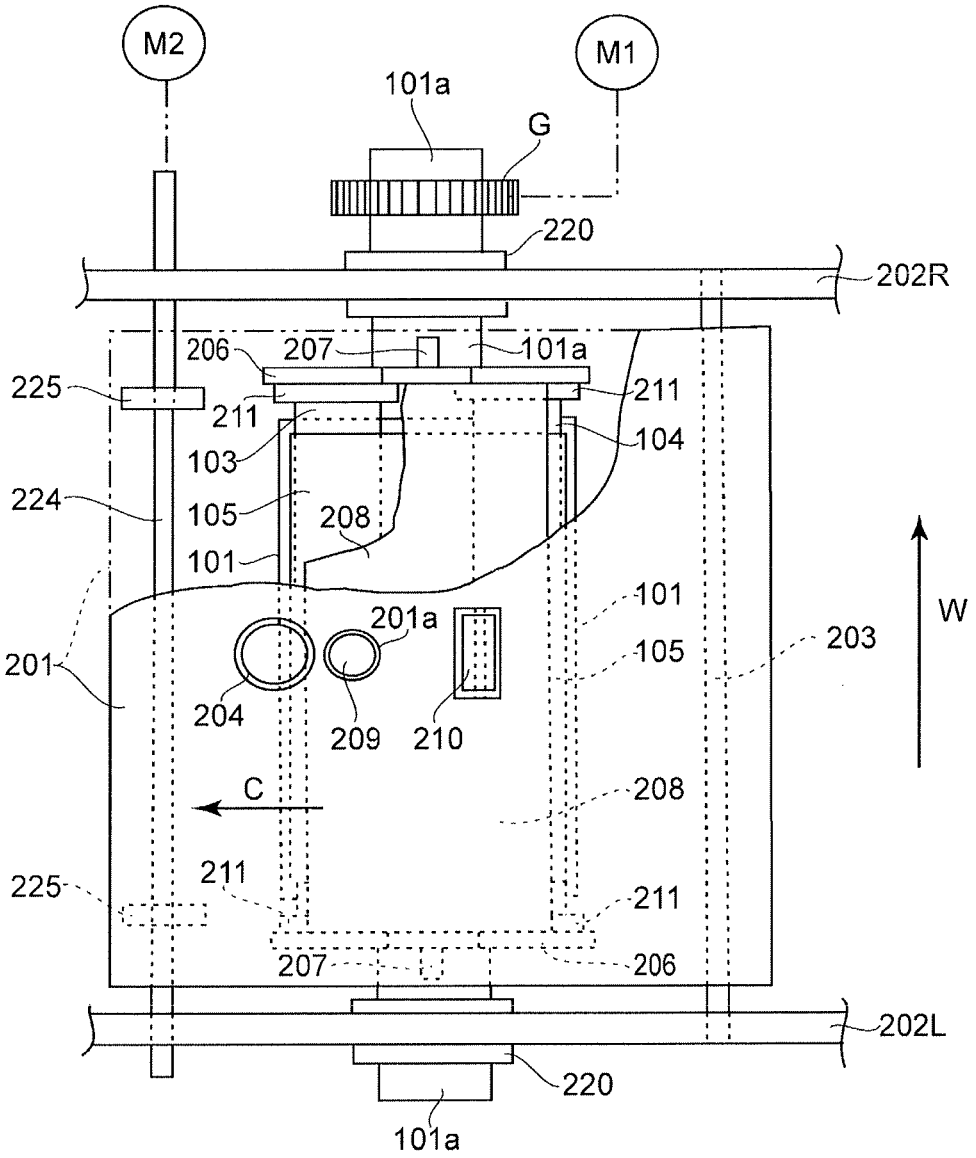
FIG. 6 is a schematic partly cut-away top plan view of the assembly.
Figure 7:
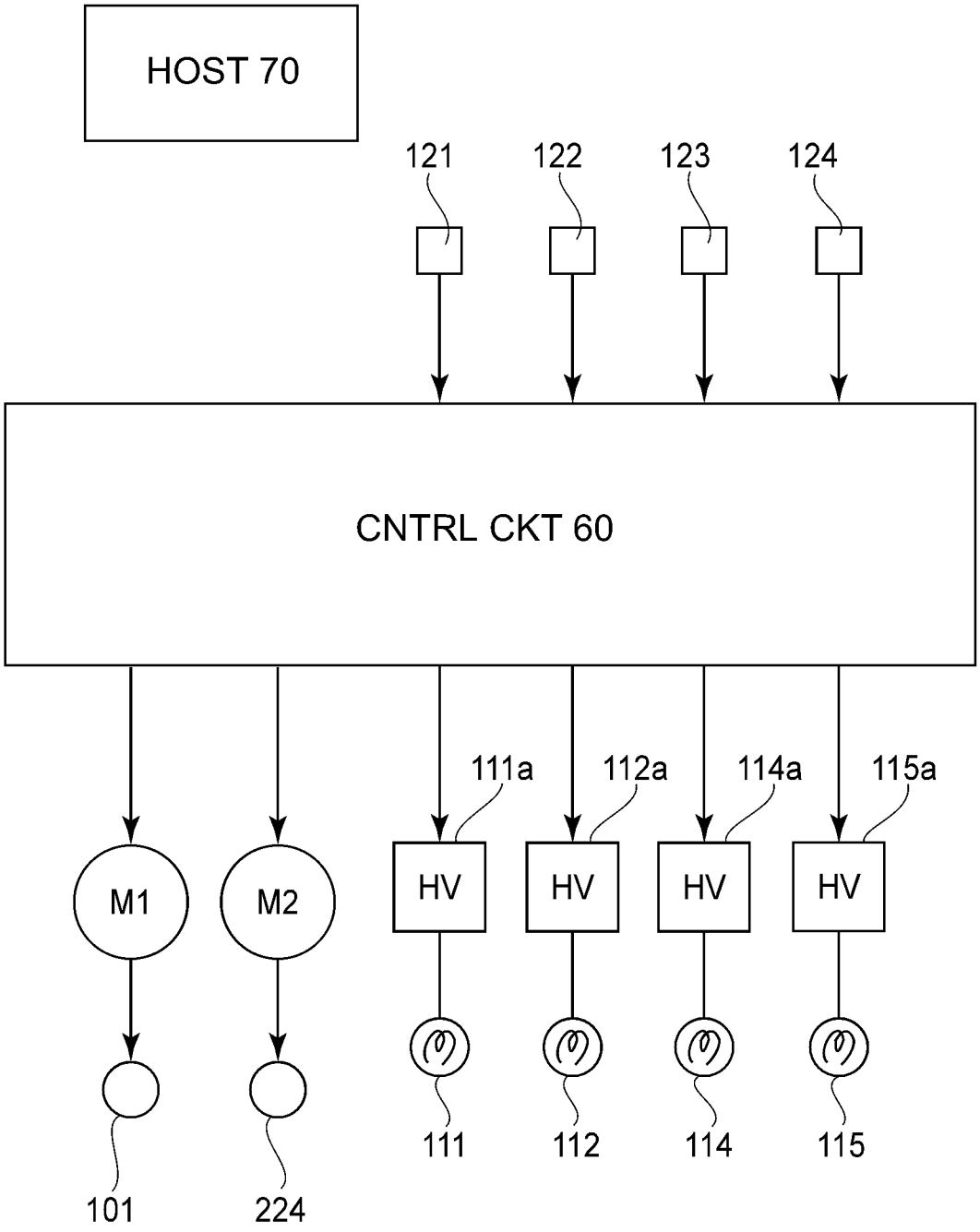
FIG. 7 is a block diagram of a control system for the fixing device.

FIG. 2 is a partly cut-away substantial front view of a major part of the fixing device 9 functioning as the image heating apparatus, FIG. 3 is an enlarged right-hand side view taken along a line (3)-(3) of FIG. 2. FIG. 4 is an exploded perspective view of an external heating belt assembly functioning as a belt unit (belt feeding device), and FIG. 5 is a perspective view of a pressing-releasing mechanism for the assembly. FIG. 6 is a partly cut-away substantial top plan view of the external heating belt assembly, and FIG. 7 is a block diagram of a control system of the fixing device.

In the following description, a longitudinal direction (widthwise direction) of the fixing device 9 and the members constituting it is the axial direction (thrust direction) of the rotatable member, or the direction substantially parallel with a direction perpendicular to the feeding direction of the recording material by the fixing device. A widthwise direction is a direction substantially parallel with the recording material feeding direction. A front side of the fixing device 9 is a recording material entrance side, a rear surface is the surface opposite therefrom (a recording material exit side), left and right are left-hand and right-hand sides as seen from the front side.

Up and down are on the basis of the direction of gravity. An upstream and downstream are based on the recording material feeding direction in the fixing device, or are based on a moving direction of the fixing roller functioning as the rotatable heating member.

The fixing device 9 comprises a fixing roller 101 functioning as rotatable heating member (heating roller, image heating member) for heating, in a nip N, the unfixed toner image K formed on the recording material (sheet) P. It also comprises a pressing roller 102 functioning as a pressing rotatable member (nip forming member) for forming the nip N for nipping and feeding the recording material in corporation with the fixing roller 101. It further comprises an external heating belt assembly 110 (assembly 110) functioning as the belt unit (belt feeding device) for externally heating the fixing roller 101.

Thus, the fixing device 9 fixes the toner image on the recording material by heating and pressing the recording material P carrying the unfixed toner image K while nipping and feeding the recording material P. This embodiment, various width size recording materials are introduced to the fixing device 9 with the widthwise center of the recording material aligned with a reference line of the fixing device 9 (center-to-center alignment feeding).

1) Fixing Roller 101:

The fixing roller 101 is rotatably supported through bearing members 220 supporting left and right shaft portions 101*a* of the fixing roller 101 between the left and right main assembly side plates 202L and 202R of a fixing device frame. The fixing roller 101 comprises a hollow core metal (metal pipe) having a predetermined outer diameter and thickness, and a toner parting layer on the outer peripheral surface of the hollow core metal, or an elastic layer and toner parting layer on the hollow core metal in this order. Inside the hollow core metal, there is provided a halogen heater 111 as a heat generating element (internal heating source).

A right shaft portion 101*a* of the fixing roller 101 is provided with a drive gear G fixed thereto. To the gear G, a driving force is transmitted from a driving source controlled by the control circuit portion (controlling means, controller) 60. By this, the fixing roller 101 is rotated in the clockwise direction indicated by the arrow A in FIG. 3 at a predetermined speed.

To the halogen heater 111, electric power is supplied through an electric energy supply line (unshown) from a voltage source portion 111*a* controlled by the control circuit portion 60. By this, the heater 111 generates heat to heat the fixing roller 101 from the inside. A thermister 121 functioning as a temperature detecting means (temperature sensor) is elastically contacted by an elastic supporting member (unshown) to an outer surface of the fixing roller 101 at a longitudinally central portion thereof. The thermister 121 detects an outer surface temperature of the fixing roller 101, and the detected temperature is fed-back to the control circuit portion 60.

The control circuit portion 60 controls the electric power to be supplied to the heater 111 from the voltage source portion 111*a* so that the detected temperature (information relating to the outer surface temperature) is maintained at a predetermined target temperature (information corresponding to a predetermined temperature or fixing temperature). More particularly, the heater 111 is rendered ON/OFF to control the surface temperature of the fixing roller 101 at the predetermined target temperature (temperature control).

2) Pressing Roller 102:

The pressing roller 102 extends in parallel with the fixing roller 101 below the fixing roller 101 and is rotatably supported between the main assembly side plates 202 and 202R by bearing members 221 supporting the shaft portions 102*a*. The pressing roller 102 comprises a hollow core metal (metal pipe) having predetermined outer diameter and thickness, and a toner parting layer, or an elastic layer and toner parting layer on the outer peripheral surface thereof in this order. Inside the hollow core metal, there is provided an halogen heater 112 as a heat generating element.

The left and right bearing members 221 are slidable in the vertical direction relative to the main assembly side plates 202L and 202R, and is urged upwardly by a compression reaction force of the urging spring (urging member) 222 as pressing means. By this, the upper surface of the pressing roller 102 is press-contacted to the lower surface of the fixing roller 101 at a predetermined urging force, by which a fixing nip N having a predetermined width with respect to the recording material feeding direction between the fixing roller 101 and the pressing roller 102. The pressing roller 102 is rotated by the rotation of the fixing roller 101 in the counter-clockwise direction B indicated by the arrow.

To the halogen heater 111, electric power is supplied through an electric energy supply line (unshown) from a voltage source portion 111*a* controlled by the control circuit portion 60. By this, the heater 112 generates heat to heat the pressing roller 102 from the inside. A thermister 122 functioning as a temperature detecting means (temperature sensor) is elastically contacted by an elastic supporting member (unshown) to an outer surface of the pressing roller 102 at a longitudinally central portion thereof. The thermister 122 detects an outer surface temperature of the pressing roller 102, and the detected temperature is fed-back to the control circuit portion 60.

The control circuit portion 60 controls the electric power to be supplied to the heater 112 from the voltage source portion 112*a* so that the detected temperature (information relating to the outer surface temperature) is maintained at a predetermined target temperature. More particularly, the heater 111 is rendered ON/OFF to control the surface temperature of the fixing roller 101 at the predetermined target temperature.

In this example, a warming-up process for the fixing device is started with actuation of the main voltage source of the image forming apparatus (rendering the main switch ON). In the warming-up process, the fixing roller 101 and the pressing roller 102 are heated up to respective target temperatures by the heaters to provide a stand-by state in which the image formation (fixing process (image heating process)) is capable of starting. At this time, an external heating belt which will be described hereinafter is also heated up to a target temperature by a heater provided therein. At this time, the external heating belt is spaced from the fixing roller.

When the printing instructions (image formation start signal) are produced, the control circuit portion 60 controls various equipment of the image forming apparatus to carry out the toner image formation on the recording material. Thereafter, the external heating belt is brought into contact to the fixing roller in timed relation with entrance of the recording material into the nip N. As a result, the external heating belt heats the fixing roller from the outside while being rotated by the fixing roller. When the recording material P carrying the unfixed toner image K is introduced from side image forming station to the fixing nip N, the recording material P is subjected to the heat and pressure, so that the unfixed toner image K is fixed on the recording material P as the fixed image.

When the image formation (fixing process) is completed, the external heating belt is spaced from the fixing roller, by which the external heating belt, the fixing roller and the pressing roller become in the stand-by state. In the stand-by state, the temperatures of the external heating belt, the fixing roller and the pressing roller are maintained at the respective stand-by temperatures by controlling the respective heaters by the control circuit portion 60. In FIG. 3, designated by D is the feeding direction of the recording material P.

3) External Heating Belt Assembly 110:

As shown in FIG. 3, the external heating belt assembly 110 functioning as the belt unit (belt feeding device) is disposed at an upper side opposing the pressing roller through the fixing roller 101 therebetween so as to heat the fixing roller 101 from the outside (external heating means).

The assembly 110 is provided with an external heating belt 105 (belt 105) functioning as an external heating member for heating the fixing roller 101 from the outside, and the belt 105 is a flexible endless belt. In this embodiment, the belt 105 comprises a flexible base material of metal such as stainless steel or nickel, and a fluorine resin material coating as a heat resistive low sliding layer for preventing deposition of the toner thereto.

The assembly 110 further comprises a plurality of supporting rollers disposed with predetermined clearances, more particularly a first supporting roller 103 and the second supporting roller 104, by which the belt 105 is stretched with a predetermined tension therearound. As shown in FIG. 3, the supporting rollers 103 and 104 are juxtaposed in this order along the rotational moving direction of the fixing roller 101. Thus, the supporting roller 104 is disposed downstream of the supporting roller 103 with respect to the rotational moving direction of the fixing roller 101.

The supporting roller 103 and the supporting roller 104 comprises hollow metal pipes having predetermined outer diameters and thicknesses and halogen heaters 114, 115 as heat generating elements therein, respectively. To the halogen heaters 114, 115, the electric power is supply through electric energy supply lines (unshown) from voltage source portions 114*a*, 115*a* controlled by the control circuit portion 60, respectively. By this, the heater 114, 115 generate heat so as to heat the supporting roller 103 and the supporting roller 104 from the inside. The supporting roller 103 and the supporting roller 104 are heated in this manner, and the belt 105 rotated by the rotation of the fixing roller 101 is heated over the entire circumference by the supporting roller 103 and the supporting roller 104.

In a contact region between the supporting roller 103 and the belt 105 (belt contacting portion to the roller 103) D1 (FIG. 3), a thermister 123 as a temperature detecting means (temperature sensor) is elastically contacted by an elastic supporting member (unshown) to the outer surface of the belt 105 at a widthwise central portion. By the thermister 123, the surface temperature of the belt 105 is detected, and the detected temperature information is fed-back to the control circuit portion 60.

The control circuit portion 60 controls the electric power to be supplied to the heater 114 from the voltage source portion 114*a* so that the detected temperature supplied from the thermister 123 is maintained at a predetermined target temperature. That is, by rendering the heater 114 ON/OFF, the surface temperature of the belt 105 is controlled at a predetermined target temperature.

In a contact region (contacting portion of the belt to the roller 104) D2 (FIG. 3) between the supporting roller 104 and the belt 105, a thermister 124 as a temperature detecting means (temperature sensor) is elastically contacted by an elastic supporting member (unshown) to the outer surface of the belt 105 at the widthwise central portion thereof. By the thermister 124, the surface temperature of the belt 105 is detected, and the detected temperature information is fed-back to the control circuit portion 60.

The control circuit portion 60 controls the electric power to be supplied to the heater 115 from the voltage source portion 115*a* so that the detected temperature (information relating to the outer surface temperature) supplied from the thermister 124 is maintained at a predetermined target temperature. That is, by rendering the heater 115 ON/OFF, the surface temperature of the belt 105 is controlled at a predetermined target temperature.

In this example, the target temperature (target temperatures of the supporting rollers 103, 104) of the belt 105 is selected so as to higher than the target temperature of the fixing roller 101. Therefore, even if is surface temperature of the fixing roller 101 drops as a result of being contacted by the recording material P in the nip N, the heat is supplied from the belt 105 to the fixing roller 101 with high responsivity (responsivity of temperature maintaining property), and therefore, the temperature of the portion of the fixing roller 101 at the entrance of the nip N can be maintained properly.

In addition, supporting rollers 103, 104 are each provided with a regulating member 211 to prevent widthwise offset (disengagement from the supporting roller) of the belt 105 (offset in the direction of the axial direction of the supporting roller 103 or 104) when the belt 105 is rotated by the fixing roller 101. The regulating member 211 functions to prevent relative displacement of the belt 105 relative to the supporting roller 103 (104) and are fixed in the neighborhood of the opposite axial ends of the supporting roller 103 (104).

In this example, the regulating member 211 is co-axially provided with the supporting roller 103 (104) and has a ring configuration (circular flange, circular flange seat) having an outer diameter larger than the outer diameter of the supporting roller 103 (104).

The assembly 110 includes two bearing plate (supporting member) 206 for rotatably supporting rollers 103, 104 at the opposite end portions thereof, as shown in FIG. 4. The bearing plates 206 hold of supporting rollers 103, 104 substantially parallel with each other so that an axis-to-axis distance of the supporting rollers 103, 104 is constant. In this embodiment, one bearing plate supports two supporting rollers, but four bearing plates may be provided to support two supporting roller, individually.

In addition, as shown in FIG. 4, the assembly 110 includes an intermediary frame 208 functioning as a connecting member for connecting the two bearing plates 206. In other words, two bearing plates 206 are unified by the intermediary frame 208. More specifically, two bearing plates 206 are provided with hole portions, respectively, which receive the shafts 207 provided at the opposite longitudinal ends of the intermediary frame 208. Therefore, the two bearing plates 206 are independently rotatable about the shafts 207 provided at the opposite end portions of the intermediary frame 208. Thus, the intermediary frame 208 rotatably holds the supporting rollers 103, 104 through the two bearing plates 206 in a lower side thereof.

As shown in FIGS. 3 and 4, the intermediary frame 208 is provided, at a side opposite the side where the fixing roller 101 is provided, with a swing shaft 209 extending along a direction (a normal line direction of an upper surface of the intermediary frame 208) substantially perpendicular to a generatrix (axial direction) of the fixing roller 101. In other words, the swing shaft 209 extends along a direction substantially perpendicular to the axes of the supporting rollers 103, 104. The swing shaft 209 extends in the direction substantial parallel with a normal line direction of the surface of the belt 105 (upper side in FIG. 3, that is, a linear surface in the opposite side of the side contacting the fixing roller 101) between the supporting roller 103 and the supporting roller 104.

In this manner, in this example, the swing shaft 209 is disposed at the position opposed to the fixing roller 101 through the belt 105, and extends in the direction away from the fixing roller 101 substantially in parallel with the direction perpendicular to the axis (generatrix) of the fixing roller 101, The swing shaft 209 is provided substantially at the center portion with respect to the longitudinal direction of the intermediary frame 208 (axial direction of the supporting rollers 103, 104).

As shown in FIG. 4, the assembly 110 is provided with a cleaning roller 108 contacted to the outer surface of the upper travel portion of the belt 105 stretched around the supporting rollers 103, 104 to clean the surface of the belt. The shaft portions 108*a* of the cleaning roller 108 at the opposite longitudinal ends are rotatably supported by the bearing plates 206, respectively. It is urged to the surface of the belt 105 at a predetermined pressure by an urging member (unshown).

4) Holding Mechanism (Swing Mechanism) for Assembly 110:

A holding mechanism (swing mechanism) 240 for holding the assembly 110 (belt 105) through the swing shaft 209 provided on the intermediary frame 208 so as to be swingable.

In this example, the holding mechanism 240 includes a pressing frame 201 having a formed hole 201*a* for holding the swing shaft 209. The hole 201*a* is formed substantially at the center portion of the pressing frame 201 with respect to the longitudinal direction.

A shaft portion 209 of the intermediary frame 208 is retained to the pressing frame 201 by inserting into the hole 201*a* of the pressing frame 201 from the bottom side and fixing it by a fixing C ring. As a result, the shaft portion 209 is limited in the relative movement in the thrust direction relative to the pressing frame 201.

As shown in FIGS. 3 and 4, the pressing frame 201 is provided with a rotatable intermediary roller 210.

As a result, the intermediary frame 208 is rotatably (turnable, swingably) relative to the pressing frame 201 within a predetermined rotational angle range (crossing angle range, swing range the about the shaft portion 209 while keeping a constant clearance relative to the lower surface of the pressing frame 201 by the intermediary roller 210. Therefore, the belt 105 is swingable in the direction crossing with the direction W (FIGS. 4, 6, generatrix direction W) parallel with the generatrix of the fixing roller 101. In other words, the assembly 110 is held by the holding mechanism 240 so that a traveling direction C (FIGS. 3 and 6) of the upper travel part of the belt 105 can cross with the direction perpendicular to the generatrix direction W of the fixing roller 101.

In this example, a rotation angle range in which the traveling direction C of the upper travel portion of the belt 105 crosses relative to the generatrix direction W (axial direction) of the fixing roller 101 is ±2° (4° in total). In other words, the rotation angle range in which the axial direction of the supporting rollers 103 and 104 can cross relative to the generatrix direction of the fixing roller 101 is ±2°.

Because of this arrangement, even when the crossing angle of the belt 105 relative to the fixing roller 101 is the maximum (+2° or −2°), the region of the belt 105 that contact with the supporting rollers 103 and 104 contacts the fixing roller 101 all over the widthwise range. That is, by the supporting roller 103 and the supporting roller 104 of the belt 105, the belt 105 can be press-contacted to the fixing roller 101 all over the widthwise range.

Therefore, even when the crossing angle of the belt 105 (assembly 110) relative to the fixing roller 101 is the maximum, the area in which the belt 105 is in contact with the fixing roller 101 does not change within the range of the rotation angle range, so that the fixing roller 101 can be properly heated by the belt 105. As a result, the outer surface temperature of fixing roller 101 is kept even, so that occurrence of improper fixing can be suppressed.

5) Moving Mechanism of Assembly 110:

The belt assembly 110 is capable of making a relative movement relative to the fixing roller by a contacting-and-spacing mechanism so that the belt 105 contacts to and spaces from the fixing roller 101. This is in order to space the belt 105 from the fixing roller 101 in the stand-by state and not to contact the belt 105 to the fixing roller 101 when the image forming operation is to be carried out (in the fixing process operation). The contacting-and-spacing mechanism will be described specifically.

As shown in FIGS. 2, 5 and 6, is supported rotatably in the up-down direction about a stay shaft 203 fixed between left and right main assembly side plates 202L and 202R at the front side thereof. Between the upper surface of the pressing frame and a stationary spring receiving seat 223 of the fixing device frame above the pressing frame 201, an urging spring 204 functioning as an urging member is compressed. By this, the pressing frame 201 is urged downwardly toward the fixing roller 101 about the rotational shaft 203.

Below a rear side of the pressing frame 201, a cam shaft 224 is rotatably supported between the main assembly side plates 202L and 202R. The cam shaft 224 is provided with a couple eccentric cams 225 (left-right sides) fixed thereto. The eccentric cams 225 have the same configuration and the same phase. The rotation of the cam shaft 224 is controlled intermittently between a first angle of rotation state (chain line in FIG. 3) in which a highest cam rise portion of the eccentric cam 225 is at the top and a second angle of rotation state (solid line in FIG. 3) in which a lowest rise thereof is at the top (approx. 180°).

In the first angle of rotation state of the cam shaft 224, the pressing frame 201 rotationally lifted by the highest rise portion of the eccentric cam 225 about the shaft 203 against the pressure of the urging spring 204, and is kept at a high position (chain line in FIG. 3). In this state, the assembly 110 is away from the fixing roller 101 so that the belt 105 stretched by the supporting roller 103 and the supporting roller 104 is spaced from the fixing roller 101 (spaced state of the assembly 110).

In the stand-by state of the image forming apparatus 50, the control circuit portion 60 keeps the driving source M1 OFF to keep the fixing roller 101 at rest. The electric power supply to the heaters 111 and 112 is off, too. The cam shaft 224 is in the first angle of rotation state so that the assembly 110 is kept in the spaced state.

The control circuit portion 60 renders the driving source M1 ON in response to the input of the image formation signal to rotate the fixing roller 101. By this, the pressing roller 102 is rotated. The electric power supply to the heaters 111 and 112 is rendered ON to raise surface temperatures of the fixing roller 101 and the pressing roller 102 to predetermined target temperatures. After completion of the preparing operation for image formation, the cam shaft 224 is driven by the driving source M2 from the first angle of rotation state to the second angle of rotation state in timed relation with start of the fixing process operation. Then, with the rotation of the eccentric cam 225 such that the lowest rise portion moves upwardly, the pressing frame 201 is rotated to lower by the pressure of the urging spring 204.

Then, the lower travel portion of the belt 105 stretched by the supporting roller 103 and the supporting roller 104 is brought into contact to the upper surface of the fixing roller 101, and the supporting roller 103 and the supporting roller 104 are urged to the fixing roller 101 through the belt 105. When the lowest rise portion of the eccentric cam 225 comes to the top position, the eccentric cam 225 is brought out of contact from the pressing frame 201.

In this state, the supporting roller 103 and the supporting roller 104 are pressed uniformly toward the upper surface of the fixing roller 101 at the predetermined pressure through the belt 105 by the pressure of the urging spring 204 (contact state of the assembly 110).

In the contact state of the assembly 110, the lower travel portion of the belt 105 stretched around the supporting rollers 103 and 104 contacts to the fixing roller 101 to form a wide heating nip Y (FIG. 3 the) between the fixing roller 101 and itself. In this state, the belt 105 is rotated through the frictional force relative to the fixing roller 101 in counterclockwise direction C indicated by the arrow in accordance with the rotation of the fixing roller 101. In addition, the supporting roller 103, the supporting roller 104 and the cleaning roller 108 are rotated by the rotation of the belt 105.

As described, in this example, a wide (in the circumferential direction) heating nip Y) can be formed using the belt 105, and therefore, the apparatus can fix the image on a thick paper or the like having a large thermal capacity at a high fixing speed.

As described in the foregoing, the intermediary frame 208 (assembly 110 and belt 105 the is rotatable (turnable, swingable) about the shaft 209 relative to the pressing frame 201 (fixing roller 101), and therefore, the widthwise offset of the belt 105 can be corrected. In other words, the traveling stability of the belt 105 can be improved. In addition, in this example, the traveling stability of the belt 105 can be improved without deteriorating the function of heating the fixing roller 101 from the outside by the belt 105.

Second Embodiment

Figure 8:
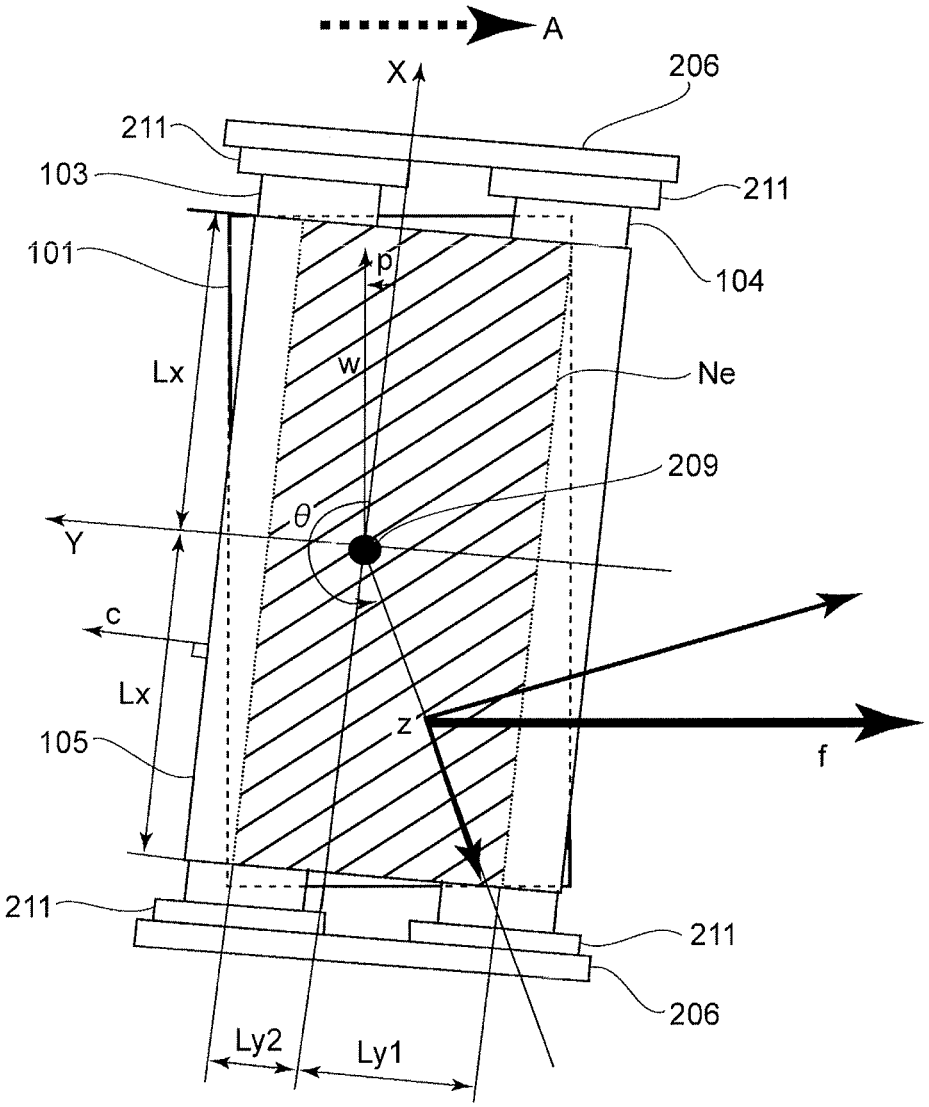
FIG. 8 illustrates a relation among the forces applied to the external heating belt when an intermediary frame is inclined relative to a fixing roller.
Figure 9:
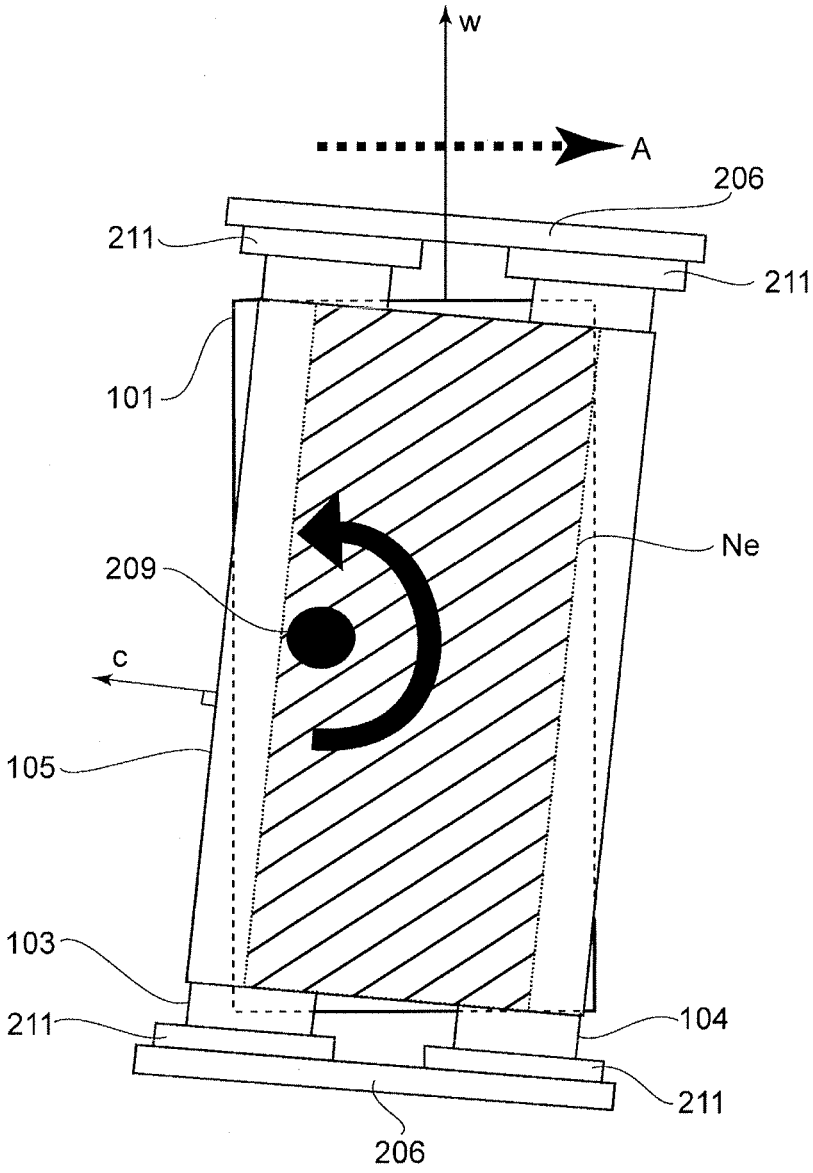
FIG. 9 is an illustration of a first embodiment when a rotational shaft is disposed upstream of a contact plane.

Referring to FIGS. 8 and 9, a second embodiment will be described. The basic structures are similar to the first embodiment, and therefore, the same reference numerals as in Embodiment 1 are assigned to the elements having the corresponding functions in this embodiment, and the detailed description thereof is omitted for simplicity.

In this example, the external heating belt assembly 110 self-actingly crosses relative to the generatrix of the fixing roller 101 so that the widthwise offset movement of the belt 105 (the relative movement of the belt 105 relative to the supporting rollers 103, 104 in the axial direction of the supporting rollers 103, 104) is corrected. The In other words, the belt assembly 110 and the holding mechanism 240 therefor have a function of so-called self-aligning the external heating belt 105.

More specifically, the position of the swing shaft 209 is offset toward an upstream side with respect to the rotational moving direction of the fixing roller 101. This will be described in detail.

First, the forces applied to the belt 105 (assembly 110) from the fixing roller 101 when the belt 105 crosses relative to the fixing roller 101 will be described.

FIG. 8 is a schematic view illustrating the state when the intermediary frame 208 is inclined relative to the fixing roller 101 by a certain angle in the state that the belt 105 is in contact with the fixing roller 101.

The belt 105 is rotated by the rotation of the fixing roller 101 through the frictional force receiving from the fixing roller 101. That is, the belt 105 is rotated by the frictional force in the direction which is the same as the rotational moving direction of the fixing roller 101 at a contact plane Ne relative to the fixing roller 101.

As described hereinbefore, the intermediary frame 208 supporting the supporting rollers 103, 104 is rotatable (swingable) about the swing shaft 209 extending in the normal line direction of the contact plane Ne relative to the fixing roller 101 of the belt 105.

A frictional force applied to a mass point Z of the belt 105 in the contact plane Ne at this time causes the intermediary frame 208 (assembly 110, belt 105) about the shaft 209, in which the rotation moment is as follows (equation (1), FIG. 8):

Here, as shown in FIG. 8, the contact plane Ne of the belt 105 fills the region provided by expanding the area of the belt 105 contacting the fixing roller 101 in a X-Y plane. Here, the X axis has a point of origin at the axis of the swing shaft 209 and extends substantially parallel with the axial direction (widthwise direction of the belt 105) of the supporting roller 103 (supporting roller 104), wherein an upper side beyond the point of origin is a positive side, in FIG. 8. The Y axis has a point of origin at the axis of the swing shaft 209 and is perpendicular to the X axis, and is substantially parallel with the traveling direction C of the upper traveling portion of the belt 105. In addition, (r, θ) is coordinates of the mass point on the basis of the point of origin of the shaft 209 projected on the contact plane Ne, f is the frictional force applied to the mass point, ρ is the crossing angle (inclination angle, swing angle) between the fixing roller 101 and the intermediary frame 208. The direction of the moment is positive in the counterclockwise direction.

$$M=-rf\cos(\theta-\rho) \quad (1)$$

A sum M1 of the moment in the negative side of the X axis and a sum of the moment M2 in the positive side of the X axis are obtained by integration in the areas and are expressed as follows:

$$M1=f/2\times Lx(Ly1)^2\times\sin\rho \quad (2)$$

$$M2=-f/2\times Lx(Ly2)^2\times\sin\rho \quad (3)$$

Here, Lx is a distance from a projected position of the shaft 209 onto the contact plane Ne between the belt 105 and the fixing roller 101 to the widthwise end portion of the belt. In addition, Ly1 is a distance from the position of the shaft 209 to a downstream side end portion of the contact plane Ne with respect to the moving direction of the belt 105. Moreover, Ly2 is a distance from the position of the shaft 209 to an upstream side end portion of the contact plane Ne with respect to the moving direction of the belt 105.

From the equations, the moment M1 applied to the belt 105 (assembly 110) in the negative side area of the X axis is always positive, which decreases the crossing angle ρ. On the other hand, the moment M1 applied to the belt 105 (assembly 110) in the positive side area of the X axis is always negative, which increases the crossing angle ρ. The moments are proportional to square of the distances Ly1 and Ly2, respectively, and therefore, the total sum (M1+M2) of the moments is different depending on the position of the shaft 209.

FIG. 9 is a top plan view of the external heating belt 105 as seen from a side away from the fixing roller 101.

As described hereinbefore, in this example, the position of the swing shaft 209, when projected onto the contact plane Ne between the fixing roller 101 and the belt 105, is offset from the center of the contact plane Ne toward upstream with respect to the rotational moving direction A of the fixing roller 101 in the contact plane Ne. In addition, the swing shaft 209 is disposed so as to overlap with the supporting roller 103.

In this case, in the contact plane Ne, a contact region in the downstream side of the shaft 209 with respect to the moving direction of the belt 105 is larger than a contact region within upstream side of the shaft 209 with respect to the moving direction of the belt 105. Therefore, the total sum of the moments is positive. By doing so, the crossing angle decreases by the rotation of the intermediary frame 208, so that a fixing roller 101 and the supporting rollers 103 and 104 become substantially parallel with each other. In addition, an absolute value of the moment is proportional to sin ρ, and therefore, the moment decreases with decrease of the crossing angle ρ, so that the intermediary frame 209 is stabilized at the attitude with which the widthwise offset movement of belt 105 does not easily occur.

In this manner, the shaft 209 is disposed at a position offset from the center position of the contact plane Ne toward the upstream side with respect to the rotational moving direction of the fixing roller 101, by which the belt 105 self-actingly is placed at the position at which the widthwise offset movement thereof does not easily occur.

Figure 10:
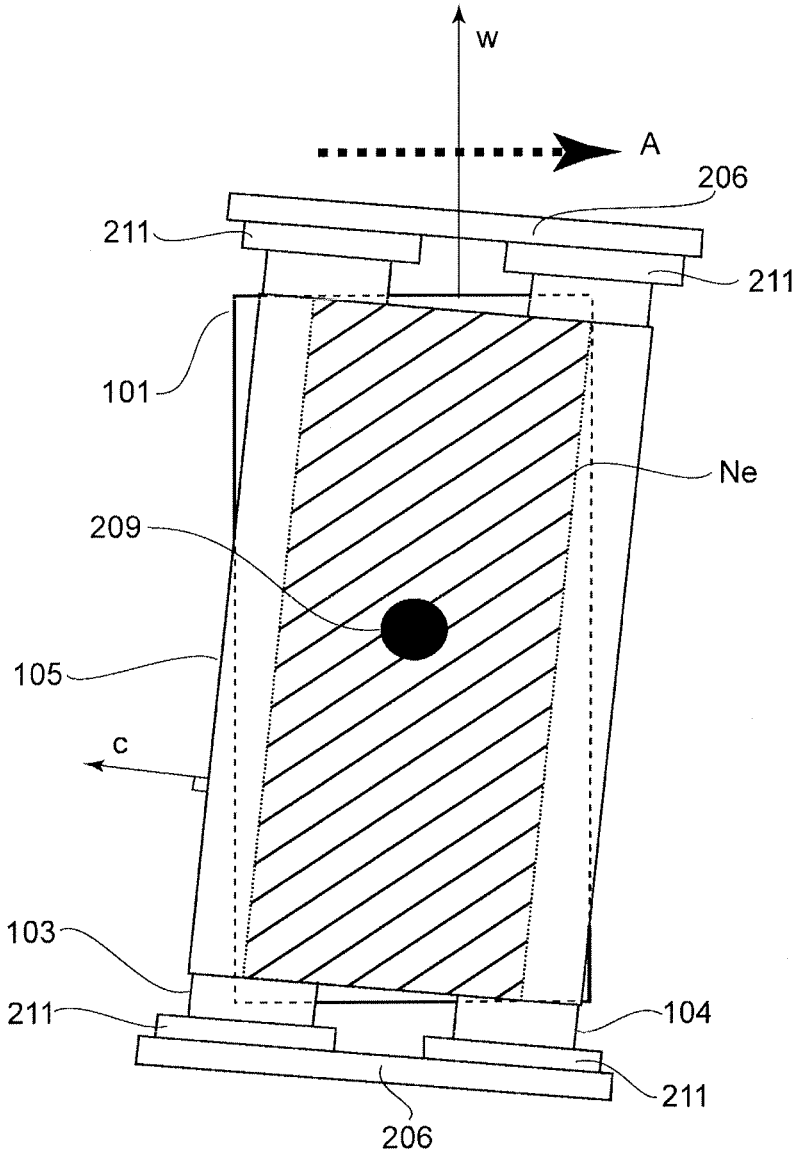
FIG. 10 is an illustration when the rotational shaft is disposed at a center of the contact plane.

On the other hand, FIG. 10 shows the case in which the position of the swing shaft 209, when projected onto the contact plane Ne between the fixing roller 101 and the belt 105, is at the center of the contact plane Ne with respect to the rotational moving direction A of the fixing roller 101 in the contact plane Ne. In this case, in the contact plane Ne, a contact region in the downstream side of the shaft 209 with respect to the moving direction of the belt 105 is the same as a contact region within upstream side of the shaft 209 with respect to the moving direction of the belt 105, and therefore, the total sum of the moments is 0. Therefore, no force that rotates the intermediary frame 208 is produced, and therefore, the crossing angle ρ tends to be unchanged, thus keeping this state. In other words, the self-alignment function of the belt 105 is not expected.

Figure 11:
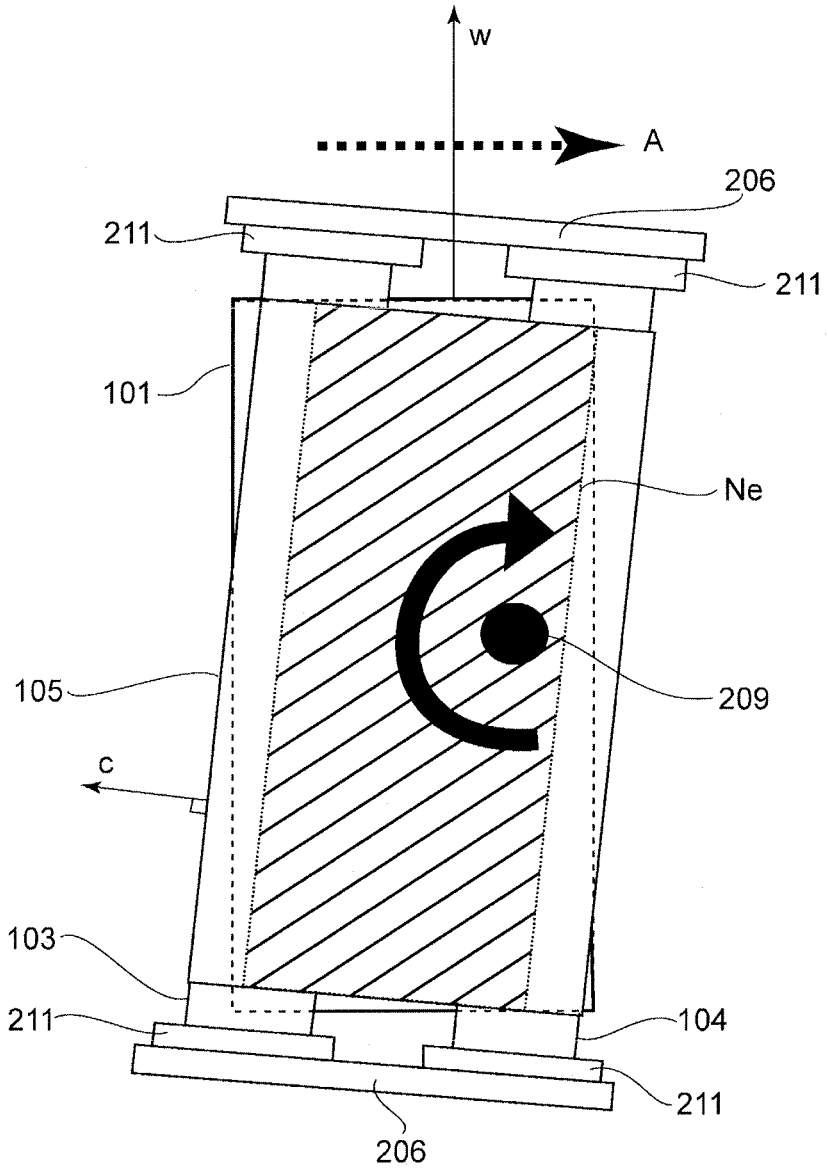
FIG. 11 is an illustration when the rotational shaft is disposed downstream of the contact plane.

FIG. 11 illustrates a case in which the position of the swing shaft 209, when projected onto the contact plane Ne between the fixing roller 101 and the belt 105, is offset from the center of the contact plane Ne toward downstream with respect to the rotational moving direction A of the fixing roller 101 in the contact plane Ne. In this case, in the contact plane Ne, a contact region in the upstream side of the shaft 209 with respect to the moving direction of the belt 105 is larger than a contact region within downstream side of the shaft 209 with respect to the moving direction of the belt 105. In such a case, the crossing angle ρ tends to increase, with the result of further deviation of the parallelism between the fixing roller 101 and the supporting rollers 103 and 104, and therefore, the widthwise offset of the belt is accelerated.

From the foregoing, by the position of the swing shaft 209, when projected onto the contact plane Ne between the fixing roller 101 and the belt 105, being offset from the center of the contact plane Ne toward upstream with respect to the rotational moving direction A of the fixing roller 101 in the contact plane Ne, the widthwise deviation of the belt 105 can be self-actingly suppressed. The moment applied to the intermediary frame 208 increases with increase of the offset amount toward the upstream side with respect to the rotational moving direction A of the fixing roller, but taking into account the upsizing of the fixing device 9, it is preferably neighborhood of the axis of the supporting roller 103 which is in the upstream of the fixing roller with respect to the rotational moving direction as shown in this example (FIG. 8).

Third Embodiment

Figure 12:
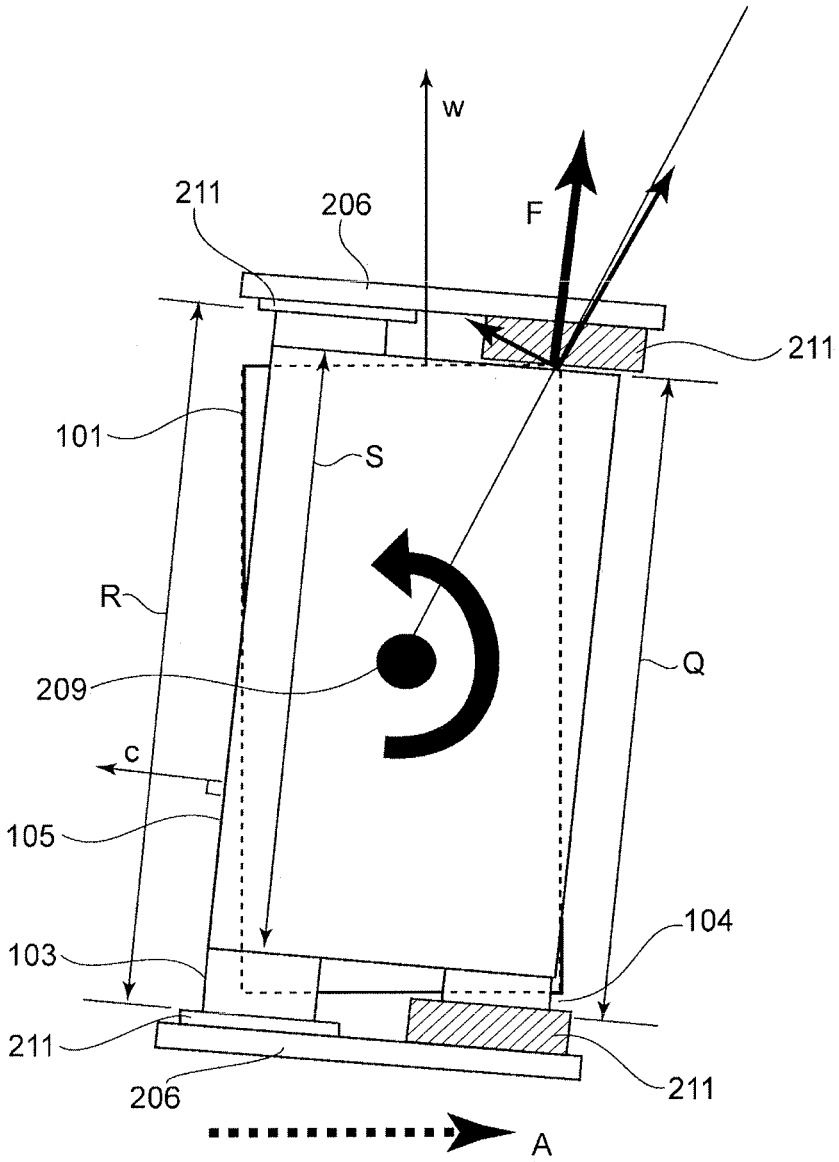
FIG. 12 is a schematic illustration in the state that the external heating belt contacts a downstream side belt regulating member in second embodiment.

Referring to FIG. 12, a third embodiment will be described. The basic structures are similar to the first embodiment, and therefore, the same reference numerals as in Embodiment 1 are assigned to the elements having the corresponding functions in this embodiment, and the detailed description thereof is omitted for simplicity.

In this example, the distances between the regulating members 211 provided in at the opposite end portions of the supporting rollers 103, 104 are selected as follows. As shown in FIG. 12, the distance between the regulating members 211 provided at the opposite end portions of the supporting roller 104 is smaller distance between the regulating members 211 provided at the opposite end portions of the supporting roller 103. S is a dimension measured in the widthwise direction of the belt 105. That is, R>Q>S.

That is, the regulating members 211 are provided in the downstream side and the upstream side of the shaft 209 with respect to the moving direction A of the fixing roller 101, the regulating members 211 of the downstream side are inside the regulating member 211 of the upstream side in the longitudinal direction relative to the supporting roller 104. Therefore, when the belt 105 becomes offset to a limit, the belt 105 hits first to the regulating member 211 of the supporting roller 104.

FIG. 12 is a schematic Figure illustrating the state in which the intermediary frame 208 inclines relative to the fixing roller 101 to the extent that the belt 105 hits only the regulating member 211 of the supporting roller 104. At this time, the intermediary frame (208) rotating moment provided from the shifting force applied to the regulating member 211 from the belt 105.

$$M=-rF\sin\theta \quad (4)$$

where F is the shifting force applied to the regulating member 211 from the belt 105, (r, θ) is coordinates of the regulating member 211 when the point of origin is at the shaft 209. From this equation, when the regulating member 211 is downstream of the shaft 209, θ is negative, and therefore, the moment rotating the intermediary frame 208 is positive, so that it is in the direction of decreasing the crossing angle.

Figure 13:
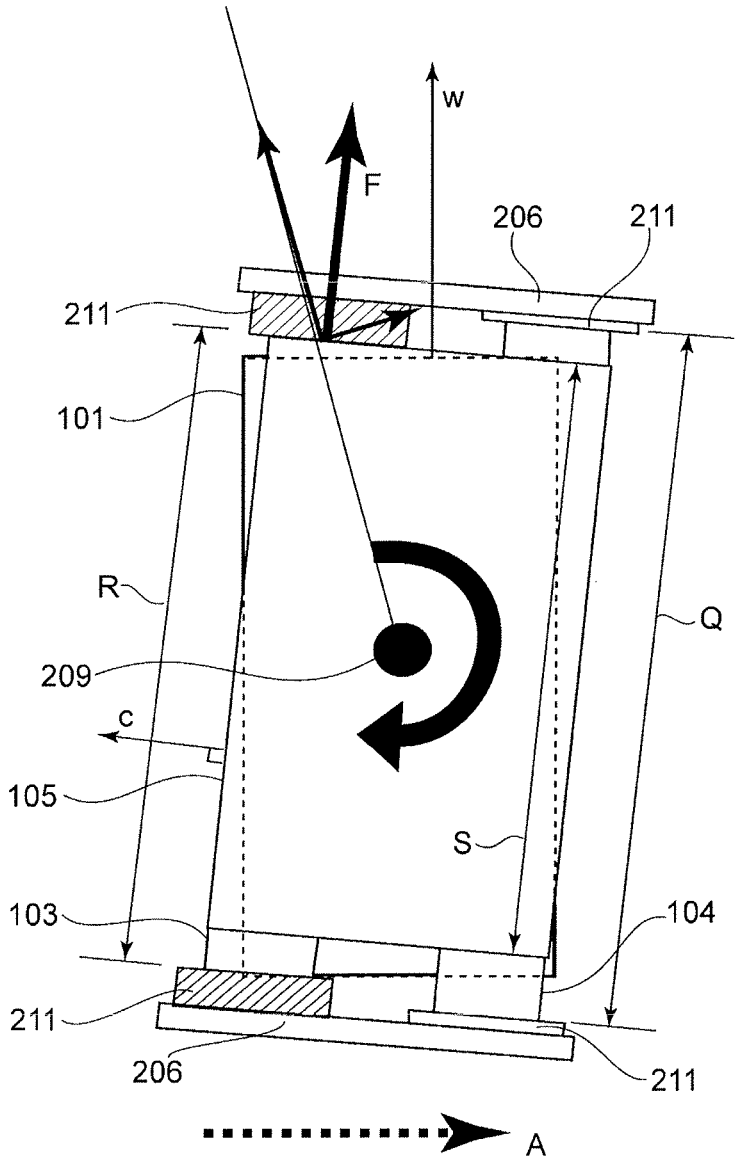
FIG. 13 is a schematic illustration in the state that the external heating belt contacts the upstream side belt regulating member.

In FIG. 13, contrary to the above-described example, the distance R between the regulating members 211 provided at the opposite end portions of the supporting roller 103 is smaller than the distance Q between the regulating members 211 provided at the opposite end portions of the supporting roller 104. That is, Q>R>S.

In this case, the belt 105 first hits the regulating member 211 of the supporting roller 103, and therefore, θ of equation (4) is positive. Therefore, the moment tending to rotate the intermediary frame 208 is negative, so that the force increases the crossing angle.

By this, the regulating member 211 is disposed downstream of the shaft 209 with respect to the rotational moving direction A of the fixing roller 101 in the plane Ne between the fixing roller 101 and the belt 105, by which the widthwise offset of the belt 105 can be efficiently suppressed.

The produced moment increases with increase of the distance between the shaft 209 and the point where the shifting force is applied. Therefore, it is understood that by disposing the shaft 209 upstream of the center of the contact plane Ne with respect to the rotational moving direction A of the fixing roller 101 in the contact plane Ne, when the shaft 209 is projected onto the contact plane Ne.

[Other Structures]

1) in the above-described embodiments, the image heating apparatus has been a fixing device, but the present invention is not limited to these examples. For example, the present invention is applicable to a glossiness increasing device (image improving device) for increasing a glossiness of an image by re-heating the image already fixed on the recording material.

2) in the above-described embodiments, the rotatable heating member (image heating member) has been a roller member, but the present invention is not limited to such an example. For example, it may be an endless belt member.

3) in the above-described embodiments, a halogen heater has been used as the means heating the endless external heating belt, but the heating type is not limited to this example. For example, the external heating belt is provided with a metal layer capable of electromagnetic induction heat generation, and the metal layer generates heat by an excitation coil.

4) in the above-described embodiments, the pressing rotatable member (pressing member) has been a roller member, but the present invention is not limited to this example. For example, it may be an endless belt member. It may be a non-rotatable member having a surface (contact surface relative to fixing roller or the recording material) with a small friction coefficient.

INDUSTRIAL APPLICABILITY

As described in the foregoing, the present invention is applicable to an image heating apparatus to improve the traveling stability of the endless belt heating the rotatable heating member from the outside.

The invention claimed is:

1. An image heating apparatus, comprising:

a rotatable heating member configured to heat a toner image on a sheet;

a belt unit including an endless belt configured to heat said rotatable heating member by contacting an outer surface of said rotatable heating member during a heating operation, and first and second rollers provided inside of said endless belt and configured to urge said endless belt to said rotatable heating member so as to contact said endless belt to said rotatable heating member during the heating operation; and a holding device configured to hold said belt unit such that an axial direction of each of said first and second rollers, which are in a state of causing said endless belt to contact said rotatable heating member, is capable of crossing a generatrix direction of said rotatable heating member.

2. An apparatus according to claim 1, further comprising a moving mechanism configured to move said holding device between a position where said endless belt is contacted with said rotatable heating member and a position where said endless belt is spaced from said rotatable heating member.

3. An apparatus according to claim 1, further comprising a rotatable member cooperating with said rotatable heating member to form a nip for nipping and feeding the sheet.

4. An apparatus according to claim 1, further comprising a driving mechanism configured to rotationally drive said rotatable heating member, wherein said endless belt is rotated by rotation of said rotatable heating member by said driving mechanism.

5. An apparatus according to claim 1, wherein said rotatable heating member is a roller.

6. An image heating apparatus, comprising:

a rotatable heating member configured to heat a toner image on a sheet, a belt unit including an endless belt configured to heat said rotatable heating member by contacting an outer surface of said rotatable heating member during a heating operation, and first and second rollers provided inside of said endless belt and configured to urge said endless belt to said rotatable heating member so as to contact said endless belt to said rotatable heating member during the heating operation; and a holding device configured to hold said belt unit swingably in such a direction that an axial direction of each of said first and second rollers, which are in a state of causing said endless belt to contact said rotatable heating member, crosses a generatrix direction of said rotatable heating member.

7. An apparatus according to claim 6, further comprising a moving mechanism configured to move said holding device between a position where said endless belt is contacted with said rotatable heating member and a position where said endless belt is spaced from said rotatable heating member.

8. An apparatus according to claim 6, further comprising a rotatable member cooperating with said rotatable heating member to form a nip for nipping and feeding the sheet.

9. An apparatus according to claim 6, further comprising a driving mechanism configured to rotationally drive said rotatable heating member, wherein said endless belt is rotated by rotation of said rotatable heating member by said driving mechanism.

10. An apparatus according to claim 6, wherein said rotatable heating member is a roller.

11. An image heating apparatus, comprising:

a rotatable heating member configured to heat a toner image on a sheet;

a belt unit including an endless belt configured to heat said rotatable heating member by contacting an outer surface of said rotatable heating member during a heating operation, and first and second rollers provided inside of said endless belt and configured to urge said endless belt to said rotatable heating member so as to contact said endless belt to said rotatable heating member during the heating operation; and a swing shaft provided in a side opposite said rotatable heating member with respect to said endless belt and extending substantially in parallel with a normal line direction of a surface of said endless belt which is between said first and second rollers; and a holding device configured to hold said belt unit swingably about said swing shaft.

12. An apparatus according to claim 11, wherein said swing shaft is disposed at an operation offset from a center position between said first and second rollers with respect to a rotational moving direction of said rotatable heating member.

13. An apparatus according to claim 12, wherein said swing shaft is disposed opposed to such one of said first and second rollers as is disposed in a downstream side with respect to the rotational moving direction of said rotatable heating member.

14. An apparatus according to claim 11, wherein said swing shaft is disposed opposed substantially to a center position with respect to the axial direction of said first roller.

15. An apparatus according to claim 11, wherein said surface of said endless belt is a surface of said endless belt relatively closer to said swing shaft at the time when said endless belt is not rotating.

16. An apparatus according to claim 11, further comprising a moving mechanism configured to move said holding device between a position where said endless belt is contacted with said rotatable heating member and a position where said endless belt is spaced from said rotatable heating member.

17. An apparatus according to claim 11, further comprising a rotatable member cooperating with said rotatable heating member to form a nip for nipping and feeding the sheet.

18. An apparatus according to claim 11, wherein said belt unit is provided co-axially with such one of said first and second rollers as is disposed on a downstream side with respect to the rotational moving direction of said rotatable heating member, and is provided with a regulating portion contactable with a widthwise end portion of said endless belt.

19. An apparatus according to claim 11, further comprising a driving mechanism configured to rotationally drive said rotatable heating member, wherein said endless belt is rotated by rotation of said rotatable heating member by said driving mechanism.

20. An apparatus according to claim 11, wherein said rotatable heating member is a roller.

21. An image heating apparatus, comprising:

a rotatable heating member configured to heat a toner image on a sheet;

a belt unit including an endless belt configured to heat said rotatable heating member by contacting an outer surface of said rotatable heating member, and first and second rollers provided inside of said endless belt and configured to rotatably support said endless belt; and a holding device configured to hold said belt unit, wherein said holding device permits tilting of said belt unit in such a direction that an axial direction each of said first and second rollers crosses a generatrix direction of said rotatable heating member so that said endless belt is moved relative to said first and second rollers in a widthwise direction of said endless belt.

22. An apparatus according to claim 21, further comprising a moving mechanism configured to move said holding device between a position where said endless belt is contacted with said rotatable heating member and a position where said endless belt is spaced from said rotatable heating member.

23. An apparatus according to claim 21, further comprising a rotatable member cooperating with said rotatable heating member to form a nip for nipping and feeding the sheet.

24. An apparatus according to claim 21, further comprising a driving mechanism configured to rotationally drive said rotatable heating member, wherein said endless belt is rotated by rotation of said rotatable heating member by said driving mechanism.

25. An apparatus according to claim 21, wherein said rotatable heating member is a roller.

* * * * *